US006406742B1

(12) United States Patent
Hasegawa et al.

(10) Patent No.: US 6,406,742 B1
(45) **Date of Patent: *Jun. 18, 2002**

(54) METHOD OF MANUFACTURING A CATHODE RAY TUBE AND APPARATUS MANUFACTURING THE SAME

(75) Inventors: Takahiro Hasegawa, Gyoda; Shigeru Sugawara, Saitama-ken; Fumihito Suzuki, Fukaya; Fumio Miyanaga, Kasai; Katsumi Yaha, Himeji, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/188,568

(22) Filed: Nov. 10, 1998

(30) Foreign Application Priority Data

Nov. 11, 1997 (JP) ..... 9-308628
Oct. 27, 1998 (JP) ..... 10-305550

(51) Int. Cl.[7] ..... B05D 5/12; B05D 7/22; B05D 1/02

(52) U.S. Cl. ..... 427/64; 427/72; 427/105; 427/106; 427/231; 427/233; 427/236; 118/317

(58) Field of Search ..... 427/105, 106, 427/64, 72, 231, 233, 236; 118/317

(56) References Cited

U.S. PATENT DOCUMENTS 1,999,014 A * 4/1935 Biggs et al. ..... 313/116
2,828,216 A * 3/1958 Delrieu ..... 427/71
2,982,669 A * 5/1961 Stewart ..... 428/428
4,092,444 A * 5/1978 Kilchowski ..... 427/64
4,232,629 A * 11/1980 Eddy ..... 118/669
4,482,579 A * 11/1984 Fujii et al. ..... 427/64
4,690,327 A * 9/1987 Takai et al. ..... 239/226
5,043,187 A * 8/1991 Takahashi ..... 427/273
5,690,992 A * 11/1997 Van Hout ..... 427/64
5,952,777 A * 9/1999 Sugawara
6,121,724 A 9/2000 Hasegawa

FOREIGN PATENT DOCUMENTS

JP 5-205660 8/1993
JP 7-29517 1/1995

* cited by examiner

*Primary Examiner*—Timothy Meeks
*Assistant Examiner*—Michael Cleveland
(74) *Attorney, Agent, or Firm*—Pillsbury Winthrop LLP

(57) ABSTRACT

A coating apparatus for forming a high-resistance film on the inner surface of the neck of the funnel of a cathode ray tube has a nozzle that can be inserted into the neck. The nozzle, which is provided for applying a material liquid to the inner surface of the neck, has a jet hole inclined toward the direction of gravity. The material liquid applied through the jet hole thus inclined scarcely flows upwardly on the inner surface of the neck. The liquid therefore forms a high-resistance film having a uniform thickness on the inner surface of the neck of the funnel. Having a uniform thickness, the high-resistance film inhibits the charge-up of the neck potential, reducing the convergence drift caused by the charge-up of the neck potential.

11 Claims, 7 Drawing Sheets

METHOD OF MANUFACTURING A CATHODE RAY TUBE AND APPARATUS MANUFACTURING THE SAME

BACKGROUND OF THE INVENTION

The present invention relates to a method of, and an apparatus for, manufacturing a cathode ray tube such as a color image receiving tube. More particularly, the invention relates to a method of, and an apparatus for, forming a high-resistance film on the neck section of a cathode ray tube, in which an electron gun is sealed.

Generally, a color image receiving tube has an envelope composed of a panel, a funnel and a neck, which are connected, forming an integral unit.

On the inner surface of the panel, a phosphor screen is provided. The phosphor screen has a number of segments, each consisting of three phosphor stripes or dots for emitting three different colors, respectively. A shadow mask is provided in the envelope, opposing the inner surface of the phosphor screen. The shadow mask has a number of apertures.

In the neck, an electron gun is provided. The electron gun is designed to emit three electron beams, which travel in the same horizontal plane. The electron gun has a main electron lens that has a low-voltage grid and a high-voltage grid. Each grid has a hole for guiding the center beam and two holes for guiding the two side beams. The holes for guiding the side beams, made in the low-voltage grid, are eccentric to the holes for guiding the side beams, made in the high-voltage grid, so that the three electron beams may be focused and converged at the center of the phosphor screen.

Outside the funnel, a deflection yoke is provided for deflecting the three electron beams the electron gun has emitted. The deflection yoke generates a horizontal deflection magnetic field and a vertical deflection magnetic field. These magnetic fields deflect the electron beams, so that the beams may scan the phosphor screen in horizontal and the vertical directions, after passing through the apertures of the shadow mask. Thus scanned with the electron beams, the phosphor screen displays a color image.

A high-resistance film is formed on the inner surface of the neck there is formed a high-resistance film, and an inner conductor film is formed on the inner surface of the funnel. The high-resistance film has a higher resistance than the inner conductor film and is connected thereto. The high-resistance film inhibits changes (known as "charge-up") in the potential of the inner surface of the neck, that may occur when the dispersed electrons leaking through the gap between the grids impinge upon the inner surface of the neck. Namely, the high-resistance film formed on the inner surface of the neck inhibits a charge-up, thereby to stabilize the neck potential. Since the high-resistance film thus provided suppresses the changes in the neck potential, the paths of the side beams are preventing from changing in the horizontal direction in the gaps between the grids. In other words, the high-resistance film can reduce so-called "convergence drift."

The high-resistance film formed on the inner surface of the neck must have an extremely high resistance. In addition, its resistance must remain stable. Otherwise, the high-resistance film can not stabilize the neck potential.

To this end, the high-resistance film may be made of material having high resistance (e.g., chromium oxide or the like). The resistance of such a substance, however, greatly depends on temperature. That is, the resistance changes very much as the operating temperature or ambient temperature of the color image receiving tube changes. This is a problem.

In order to solve the problem, the inventors hereof have proposed a method of forming a high-resistance film, in Jpn. Pat. Appln. KOKAI Publication No. 10-134739. This method consists in coating the inner surface of the neck with a liquid composed of a solvent such as alcohol and conductive particles of tin oxide or the like dispersed in the solvent, thereby forming a high-resistance film. To disperse the conductive particles uniformly in the solvent, however, the solvent must have a relatively low viscosity. To make matter worse, the particles dispersed in the solvent are far more electrically conductive than chromium oxide or the like. As a consequence, the resistance of the high-resistance film depends on the thickness of the film.

Dip method or spray method may be employed to form a high-resistance film having a desired thickness uniformity. In the dip method, the neck is immersed in the liquid and lifted therefrom, thereby forming a high-resistance film on the inner surface of the neck. In the spray method, the liquid is sprayed onto the inner surface of the neck, thereby forming a high-resistance film thereon.

The dip method is disadvantageous in three respects. First, a much complicated apparatus must be used to perform this method, increasing the manufacturing cost of the high-resistance film. Second, the efficiency of coating is low because the amount of the liquid actually applied to the inner surface of the neck is much smaller than the pool of the liquid in which the neck is dipped. Third, the pool of the liquid is liable to contamination, and the resultant film deteriorates in quality once the pool has been contaminated.

The spray method is disadvantageous, too. The liquid is sprayed onto the inner surface of the neck. Thus, it is applied in the form of mist. The mist of the liquid diffuse in the neck, and the liquid may be applied to those parts of the neck, which need not be covered with the high-resistance film.

At present, no method are available that can form a high-resistance film of a desired thickness uniformity on the inner surface of the neck. Any high-resistance film having no desired thickness uniformity has its resistance changed with temperature, failing to inhibit the charge-up of the neck potential. As a consequence, the high-resistance film can not reduce the convergence drift.

BRIEF SUMMARY OF THE INVENTION

The present invention has been made in view of the foregoing. Its object is to provide a method of, and an apparatus for, manufacturing a cathode ray tube, in which a high-resistance film can be formed to a desired thickness on the inner surface of the neck of a tube and can therefore reduce the convergence drift caused by the charge-up of the neck potential.

To attain the object, the present invention provide a method of manufacturing a cathode ray tube comprising: an electron gun comprising an electron beam generating section for generating a plurality of electron beams which travel parallel in a horizontal plane and a plurality of electrodes spaced apart in a direction in which the electron beams travel, each electrode having a plurality of holes for guiding the electron beams; a deflection yoke for generating magnetic fields which deflect the electron beams emitted from the electron gun, in horizontal and vertical directions of a target; an envelope including a neck section which contains the electron gun, a panel section on which the target is provided, and a funnel section which connects the neck section and the panel section and which has an inner diameter flaring from the neck section to the panel section; an inner conductive film provided on an inner surface of a junction between the funnel section and the neck section; and a high-resistance film formed by coating on an inner surface of the neck section, contacting the inner conductive film, covering a part the electron gun and having a resistance higher than the inner conductive film, the method comprising the steps of: arranging the envelope, with the neck section extending in a substantially vertical direction; supplying a liquid material for forming the high-resistance film; and ejecting the liquid material toward the inner surface of the neck, such that the liquid is applied to the inner surface of the neck along a line inclined to a plane perpendicular to the inner surface of the neck, toward a direction of gravity, thereby to form the high-resistance film on the inner surface of the neck section.

To achieve the object described above, the invention provide an apparatus for manufacturing a cathode ray tube comprising: an electron gun comprising an electron beam generating section for generating a plurality of electron beams which travel parallel in a horizontal plane and a plurality of electrodes spaced apart in a direction in which the electron beams travel, each electrode having a plurality of holes for guiding the electron beams; a deflection yoke for generating magnetic fields which deflect the electron beams emitted from the electron gun, in horizontal and vertical directions of a target; an envelope including a neck section which contains the electron gun, a panel section on which the target is provided, and a funnel section which connects the neck section and the panel section and which has an inner diameter flaring from the neck section to the panel section; an inner conductive film provided on an inner surface of a junction between the funnel section and the neck section; and a high-resistance film formed by coating on an inner surface of the neck section, contacting the inner conductive film, covering a part of the electron gun and having a resistance higher than the inner conductive film, the apparatus comprising: envelope-arranging means for arranging the envelope, with the neck section extending in a substantially vertical direction; liquid-supplying means for supplying a liquid material for forming the high-resistance film; and liquid-applying means for ejecting the liquid material toward the inner surface of the neck, such that the liquid is applied to the inner surface of the neck along a line inclined to a plane perpendicular to the inner surface of the neck, toward a direction of gravity, thereby to form the high-resistance film on the inner surface of the neck section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described in detail, with reference to the accompanying drawings.

Figure 1:
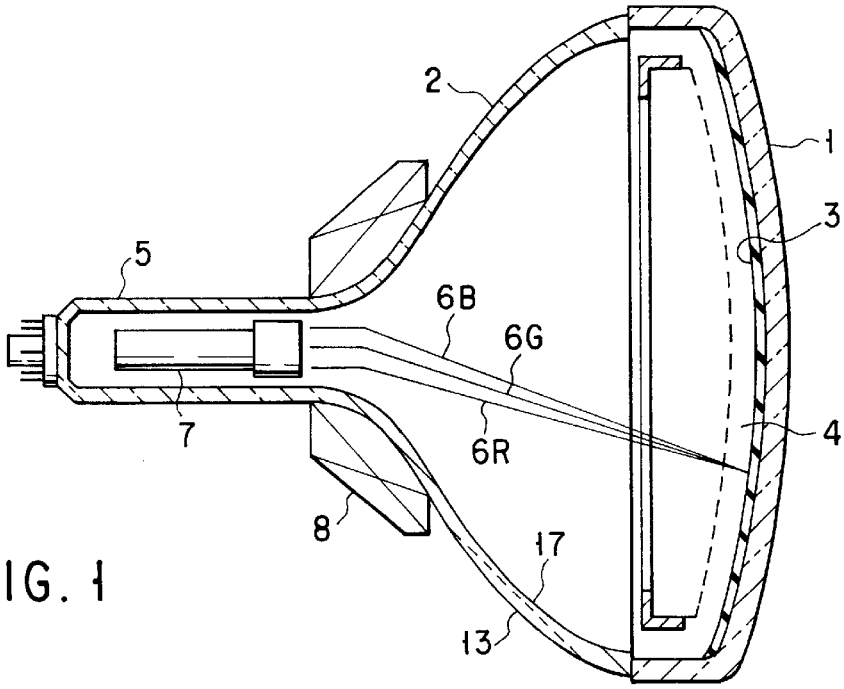
FIG. 1 is a sectional view of a color cathode ray tube manufactured by a method according to the present invention.

FIG. 1 shows a color cathode ray tube, which is a cathode ray tube manufactured by a method according to the invention. The color cathode ray tube has an envelope composed of a panel 1 and a funnel 2. The panel 1 and funnel 2 are connected, forming an integral unit.

On the inner surface of the panel 1, a phosphor screen 3 is provided. The phosphor screen 3 is comprised of a metal back layer and a tricolor phosphor layer. The tricolor phosphor layer is composed of many tricolor segments, each consisting of three phosphor stripes or dots for emitting red (R) light, green (G) light and blue (B) light, respectively. A shadow mask 4 is provided in the envelope, opposing the inner surface of the phosphor screen 3. The shadow mask 4 has a number of apertures.

The funnel 2 has a hollow cylindrical neck 5 having a inner diameter (20 mm to 40 mm), which is smaller than the inner diameter of any other part of the funnel 2. The neck 5 contains a so-called inline-type electron gun 7. The electron gun 7 is designed to emit three electron beams 6B, 6G and 6R, which travel parallel in the same horizontal plane. More precisely, in the same horizontal plane, the beam 6G, or center beam, travels between the beams 6B and 6R, or side beams.

The electron gun 7 has a main electron lens that comprises a low-voltage grid and a high-voltage grid. Each grid has a hole for guiding the center beam and two holes for guiding the two side beams. The holes made for guiding the side beams, in the low-voltage grid, are eccentric to the holes for guiding the side beams, made in the high-voltage grid, so that the three electron beams may be focused and converged at the center of the phosphor screen 3.

Outside the funnel 2, a deflection yoke 8 is provided for generating a horizontal deflection magnetic field and a vertical deflection magnetic field. The horizontal deflection magnetic field is shaped like a pincushion, whereas the vertical deflection magnetic field is shaped like a barrel. An outer low-resistance film 13 is formed on that outer surface of the funnel 2. An inner low-resistance film 17 is formed on that inner surface of the funnel 2, which is continuous to the neck 5.

In the color cathode ray tube described above, the horizontal and vertical deflection magnetic fields generated by the deflection yoke 8 deflect the three electron beams 6B, 6G and 6R emitted from the electron gun 7. The electron beams 6B, 6G and 6R deflected pass through the shadow mask 4 and scan the phosphor screen 3 in the horizontal and vertical directions, forming a color image on the phosphor screen 3.

Figure 2:
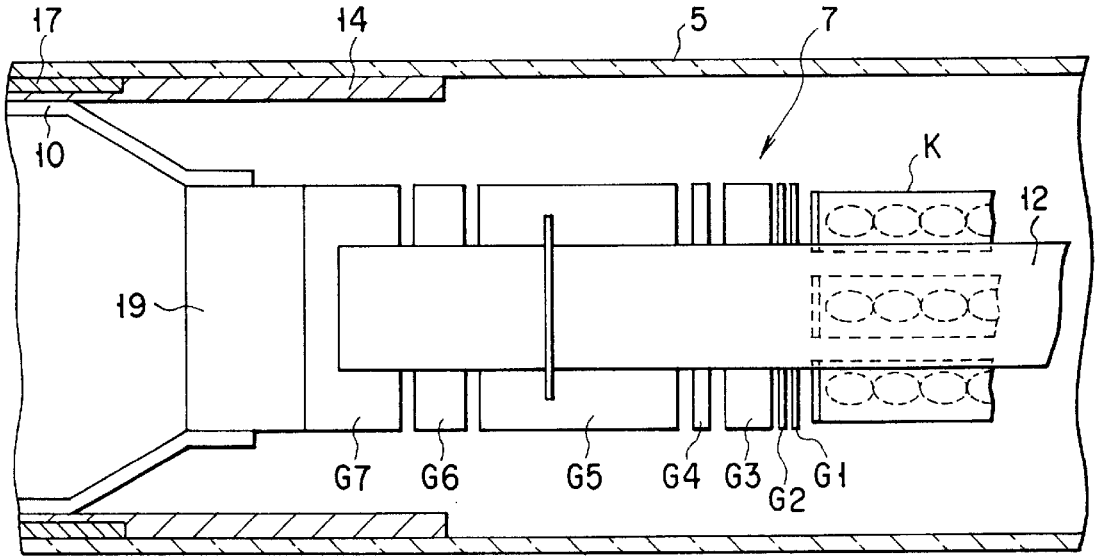
FIG. 2 is an enlarged sectional view of the neck of the funnel of the color cathode ray tube shown in FIG. 1.

FIG. 2 is an enlarged sectional view of the neck 5 of the funnel of the color cathode ray tube shown in FIG. 1. As shown in FIG. 2, the electron gun 7 of inline type, which is provided in the neck 5, comprises three cathodes K for emitting electron beams 6B, 6G and 6R, respectively, and three heaters for heating the cathodes K, respectively.

The electron gun 7 further comprises seven grids G1 to G7 and a convergence cup 19. The grids G1 to G7 are arranged in the order mentioned, from the cathodes K, and are spaced from one another by prescribed distances. The convergence cup 19 is attached to that end of the seventh grid G7 which opposes the phosphor screen 3. The first grid G1 and the second grid G2 are plate-shaped electrodes. The third to seventh grids, G3 to G7, are hollow cylindrical electrodes, each having closed two ends.

The heaters, cathodes K and grids G1 to G7 are supported together by a pair of insulative support rods (the support rods are of glass) 12, which are insulating supports. The support rods 12 are spaced apart from each other in the vertical direction that is perpendicular to the inline direction.

The first grid G1 and the second grid G2 each have three almost circular holes for guiding electron beams 6B, 6G and 6R, respectively. The holes of each of the grids G1 and G2 are arranged in the inline direction.

The third grid G3 has three almost circular holes made in its end opposing the second grid G2. The holes are larger than the holes made in the second grid G2 and arranged in the inline direction, for guiding the electron beams which have passed through the second grid G2. The third grid G3 has other three almost circular holes in the end opposing the fourth grid G4. These holes are larger than the holes made in the end opposing the second grid G2 and arranged in the inline direction, for guiding the electron beams.

The fourth grid G4 has three almost circular holes made in its end opposing the third grid G3 and also three almost circular holes made in its end opposing the fifth grid G5, all for guiding the electron beams. These holes have substantially the same diameter as those made in that end of the third grid G3 which opposes the fourth grid G4. They are arranged in the inline direction for guiding the electron beams.

Similarly, the fifth grid G5 has three almost circular holes made in its end opposing the fourth grid G4. The holes have substantially the same diameter as those made in both ends of the fourth grid G4 and arranged in the inline direction, for guiding the electron beams. The fifth grid G5 has thee other holes made in its end opposing the sixth grid G6. These holes are arranged in the inline direction, for guiding the electron beams.

The sixth grid G6 has three holes made in its end opposing the fifth grid G5. The holes are arranged in the inline direction, for guiding the electron beams. The sixth grid G6 further has three other holes made in its end opposing the seventh grid G7. These holes are almost circular, have substantially the same diameter as those made in that end of the sixth grid G6 which opposes the fourth grid G4, and are arranged in the inline direction, for guiding the electron beams.

The seventh grid G7 has three almost circular holes made in its end opposing the sixth grid G6, and three other almost circular holes made in its end contacting the convergence cup 19. All holes of the seventh grid G7 have substantially the same diameter as those made in that end of the sixth grid G6 that opposes the seventh grid G7. They are arranged in the inline direction, for guiding the electron beams.

The convergence cup 19 has three almost circular holes made in its bottom, i.e., its end contacting the seventh grid G7. These holes have substantially the same diameter as those made in the seventh grid G7. The convergence cup 19 is connected by a bulb spacer 10 to the inner low-resistance film 17. To the film 17 an anode voltage Eb is applied.

Voltages are applied also to the cathode K and the grids G1 to G7, as will be described below in detail.

The cathode K is electrically connected to a DC power supply (not shown) and a video signal source (not shown). The DC power supply applies a DC voltage of 100 to 200V, and the video signal source supplies a video signal. The DC voltage is superposed with the video signal, forming a voltage. This voltage is applied to the cathode K.

The first grid G1 is connected to the ground. The second grid G2 and the fourth grid G4 are connected to each other within the neck 5. A voltage ranging from 500V to 1000V is applied via a DC power supply (not shown) to both the second grid G2 and the fourth grid G4.

The third grid G3 and the sixth grid G6 are connected to each other within the neck 5. A DC power supply and an AC power supply (either not shown) are connected in series. The DC power supply applies a DC voltage Vf that is about 20 to 35% of the anode voltage Eb applied to the seventh grid G7. The AC power supply applies a dynamic voltage Vd that changes along a parabola curve as the electron beams are deflected. The DC voltage Vf is superimposed with the dynamic voltage Vd, generating a dynamic focusing voltage. The dynamic focusing voltage is applied to the third grid G3 and the sixth grid G6.

The fifth grid G5 is electrically connected to the third grid G3 by a resistor (not shown). At least the DC component of the dynamic focusing voltage applied to the third grid G3 is applied to the fifth grid G5.

The anode voltage Eb applied to the seventh grid G7 ranges from 25 kV to 35 kV. It is applied to the seventh grid G7 through the bulb spacer 10 and the inner low-resistance film 17.

When the various voltages of the values described above are applied, the cathode K and the first to third grids, G1 to G3, control the emission of electrons from the cathode K, and an electron beam generating section is formed in the electron gun 7. The electron beam generating section accelerates and converges the electrons emitted from the cathode K, generating electron beams. Further, the third grid G3, fourth grid G4, fifth grid G5, sixth grid G6 and seventh grid G7 constitute an electron lens, which accelerates and focuses the electron beams generated by the electron beam generating section, on the phosphor screen 3.

As shown in FIG. 2, a high-resistance film 14 having a uniform thickness is formed on the inner surface 5*a* of the neck 5, contacting the inner low-resistance film 17. The high-resistance film 14 is provided for reducing the convergence drift caused by the charge-up of the neck potential.

Figure 3:
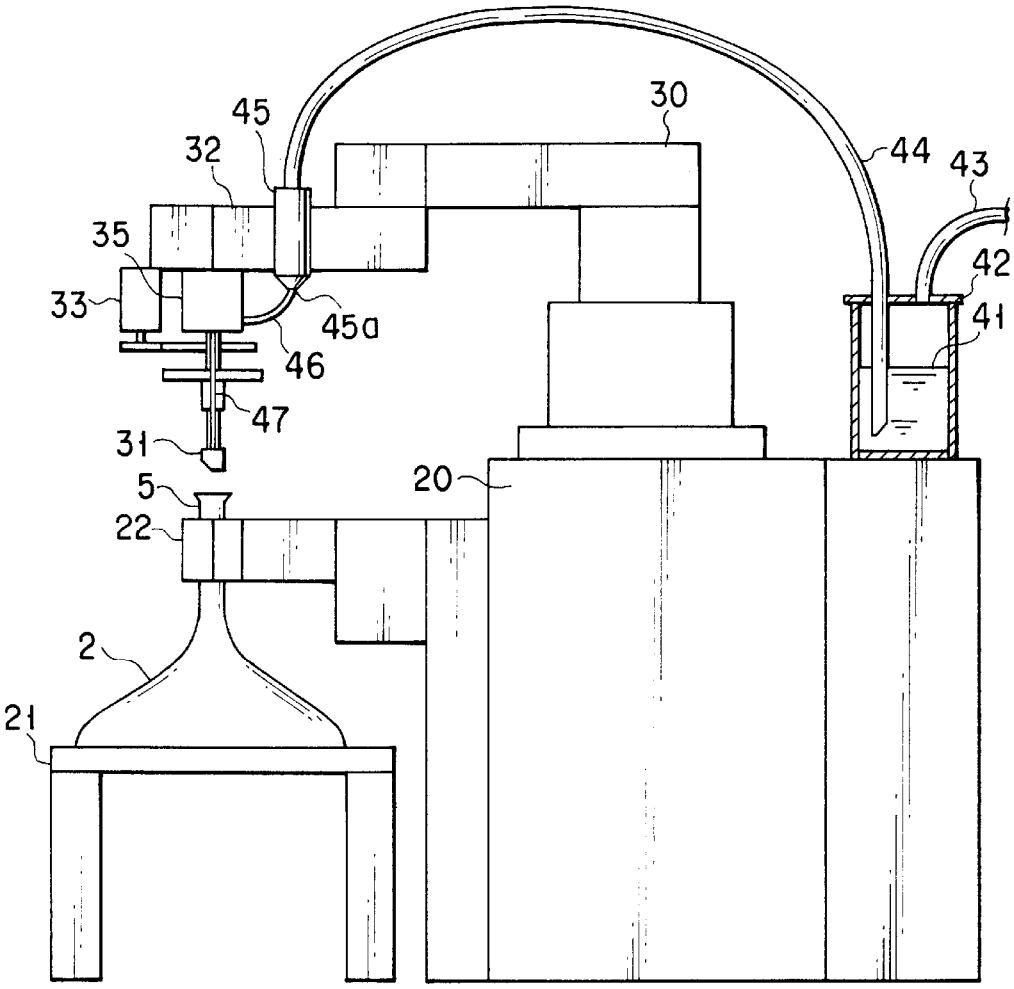
FIG. 3 is a schematic view showing a coating apparatus according to a first embodiment of the invention, which is designed to form a high-resistance film on the inner surface of the neck of the tube shown in FIG. 1.

FIG. 3 shows a coating apparatus 20 for coating and forming the high-resistance film 14 on the inner surface 5*a* of the neck 5. Namely, the apparatus 20 is one of the apparatuses that are designed to manufacture the cathode ray tube according to the first embodiment of the invention. To form the film 14, the funnel 2 of the envelope is attached to the coating apparatus 20.

The coating apparatus 20 comprises a table 21, a neck holding mechanism 22, and a robot 30. The table 21 has a horizontal amount surface, on which the funnel 2 is mounted and roughly positioned. The neck holding mechanism 22 is designed to hold and accurately position the neck 5 of the funnel 2 mounted on the table 21. The robot 30 is designed to hold a jet nozzle 31 and accurately position the jet nozzle 31 in the neck 5 held by the neck holding mechanism 22. The table 21, neck holding mechanism 22 and robot 30 are arranged at prescribed positions, assuming a desired positional relationship.

The robot 30 has an arm 32, to which the jet nozzle 31 is so connected by a rotary joint 35 as to rotate. A motor 33 is attached to the distal end of the arm 32. The jet nozzle 31 extends along the axis of the funnel 2 and can be rotated around its axis by the motor 33.

Figure 4:
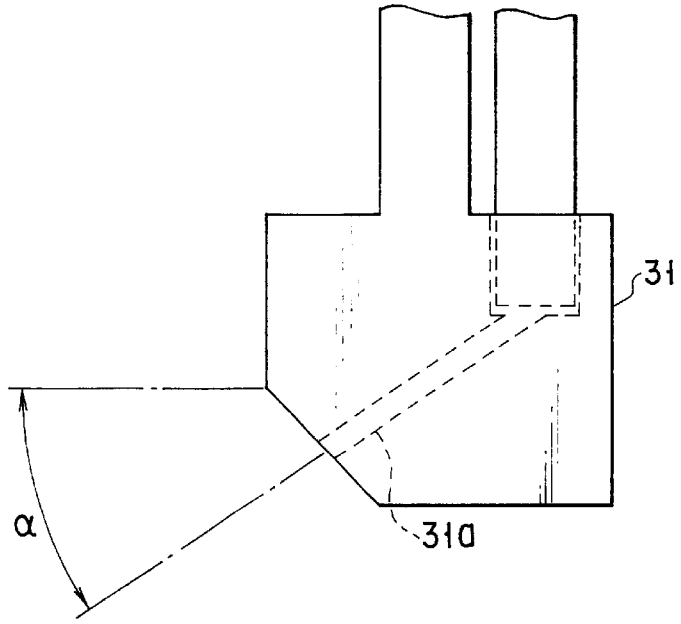
FIG. 4 is an enlarged view of the nozzle provided in the coating apparatus of FIG. 3, for applying liquid to the inner surface of the neck.

As shown in FIG. 4, the jet nozzle 31 has a jet hole 31*a*. The hole 31*a* is inclined downwards at an angle $\alpha$ to the horizontal plane.

The coating apparatus 20 has a pressure tank 42. The tank 42 contains liquid 41 that is the material of the high-resistance film 14 to be formed on the inner surface of the neck 5. The liquid material 41 is, for example, a solution made of an organic solvent such as ethyl alcohol, tin oxide particles (electrically conductive material) dispersed in the solvent, and silane coupling agent (binder) such as ethyl silicate dispersed in the solvent. The pressure tank 42 is sealed and located beside the robot 30.

A tube 43 is connected to the pressure tank 44, for introducing compressed air into the tank 43 at a prescribed pressure. A liquid-supplying tube 44 is connected, at one end, to one end of the tank 43, for supplying the liquid material 41. This tube 44 is made of material resistant to alcohol.

A feed-rate control device 45 is connected to the other end of the liquid-supplying tube 44. The device 45 incorporates a valve (not shown) and an outlet port 45*a*. The valve is opened or closed to adjust an amount of the material liquid to be supplied per unit time. A liquid-supplying tube 46 connects the outlet port 45*a* to the rotary joint 35 described above. The tube 46 is thinner than the liquid-supplying tube 44 that connects the pressure tank 42 and the feed-rate control device 45. A liquid-supplying tube 47 connects the rotary joint 35 to the jet nozzle 31. The tube 47 has substantially the same inner diameter as the liquid-supplying tube 46 that connects the outlet port 45*a* to the rotary joint 35.

In operation, compressed air is supplied at pressure of 0.2 to 2.0 kfg/cm$^2$ into the pressure tank 42 through the tube 43. The liquid material 41 is thereby forced to flow from the pressure tank 42 through the liquid-supplying tube 44. The liquid 41 thus supplied from the tank 42 is fed to the jet nozzle 31 via the liquid-supplying tube 46, rotary joint 35 and liquid-supplying tube 47, at the rate adjusted by the feed-rate control device 45. The material liquid 41 is then ejected at the prescribed rate through the inclined jet hole 31*a* of the nozzle 31.

The operation of the coating apparatus 20 described above will be explained below.

At first, the funnel 2 is mounted at a predetermined position on the table 21 of the coating apparatus 20. The coating apparatus 20 is then started. The neck holding mechanism 22 holds the neck 5 of the funnel 2 at a prescribed position.

Next, the arm 32 of the robot 30 is driven, moving the nozzle 31 to a position right above the neck 5. The nozzle 31 is lowered in the axial direction of the neck 5 until it reaches a prescribed position in the neck 5. The motor 33 is turned on, rotating the nozzle 31 at a preset speed. The rotational speed of the nozzle 31 can be set at any desired value.

When the nozzle 31 is thus rotated, the valve (not shown) incorporated in the feed-rate control device 45 is opened. The material liquid 41 is applied at a prescribed rate through the jet hole 31*a* of the nozzle 31.

Figure 5:
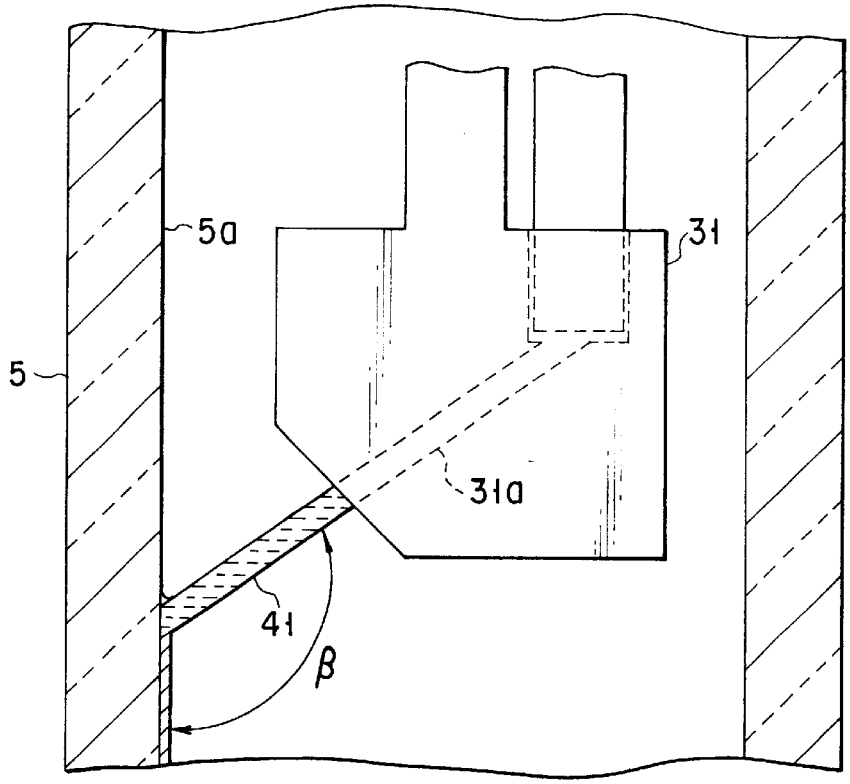
FIG. 5 is a diagram for explaining the behavior of the liquid applied from the nozzle shown in FIG. 4.

As indicated above, the jet hole 31*a* is inclined downwards at an angle $\alpha$ to the horizontal plane as shown in FIG. 4. Therefore, the material liquid 41 is applied from the nozzle 31 to the inner surface 5*a* of the neck 5, along a line inclined at an angle $\beta$ to the inner surface 5*a*, as illustrated in FIG. 5. Namely, the jet hole 31*a* is so inclined that the liquid 41 is applied to the inner surface 5*a* along a line inclined to the horizontal plane downwardly toward the direction of gravity.

Figure 6:
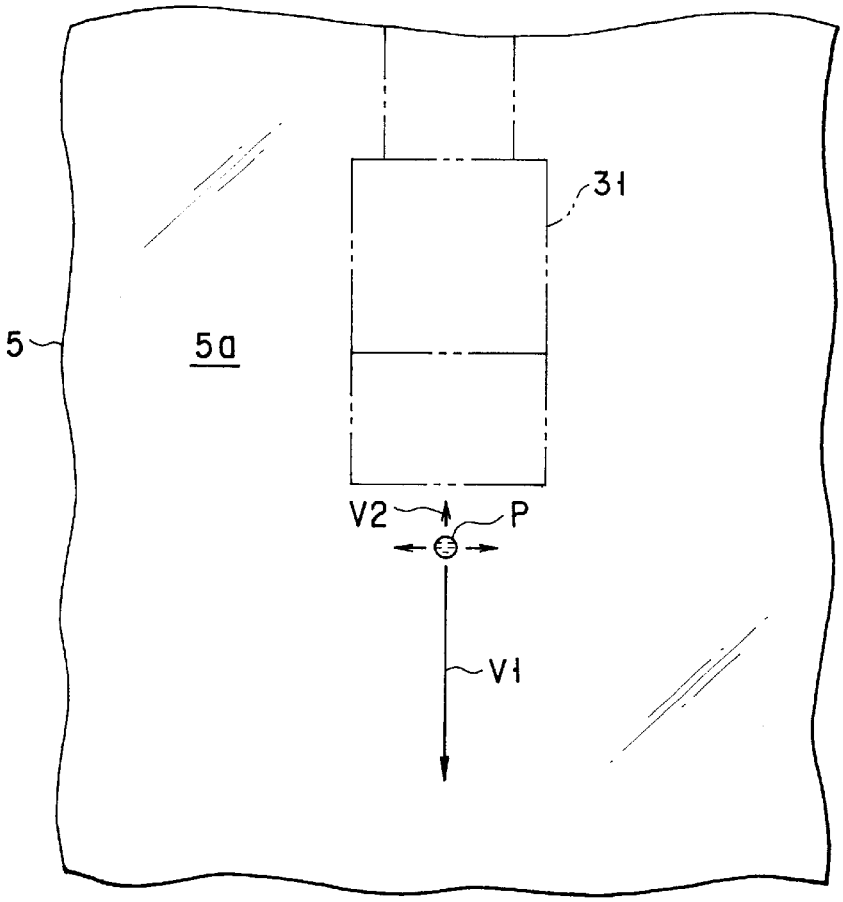
FIG. 6 is another diagram for explaining the behavior of the liquid applied from the nozzle shown in FIG. 4.

FIG. 6 schematically shows the speed vector of the liquid material 41 flowing down on the inner surface 5*a* immediately after it is applied onto the inner surface 5*a* at the angle $\beta$. For simplicity of explanation, the speed vector is illustrated as four components, i.e., an upward component, a downward component, a leftward component and a rightward component.

Most of the material liquid 41 applied to the inner surface 5*a* of the neck 5 flows downwards from the point P on the inner surface 5*a*, where the liquid 41 has been applied, as the downward vector component V1 indicates in FIG. 6. Only a small part of the liquid 41 applied to the inner surface 5*a* flows upwardly from the point P, as the upward vector component V2 indicates. That is, almost all of liquid 41 applied from the nozzle 31 flows down on the inner surface 5*a* of the neck 5.

The nozzle 31 serves to increase the thickness of uniformity of the high-resistance film 14, unlike the conventional nozzle that has a jet hole extending at right angles to the inner surface of a neck. If the material liquid 41 were applied through a jet hole extending at right angles to the inner surface 5*a*, a relatively large part of the liquid 41 would flow upwardly on the inner surface 5*a* as soon as the liquid 41 reaches the inner surface 5*a*. This part of the liquid 41 would flow upwardly slowly due to gravity and inevitably be dried, while the remaining part of the liquid 41 is forwardly fast due to gravity. Consequently, a high-resistance film having a uniform thickness could not be formed.

It is important that the jet hole 31*a* is inclined as illustrated in FIG. 4. This is because the way the material liquid 41 flows on the inner surface 5*a* of the neck 5 almost totally depends on the angle and speed at which the liquid 41 is applied from the nozzle 31. Almost all of the liquid 41 so applied from the nozzle 31 flows downwardly on the inner surface 5*a*. The liquid 41 therefore forms a high-resistance film 14 with a uniform thickness, on the inner surface 5*a* of the neck 5.

Since the jet hole 31*a* is inclined, the material liquid 41 scarcely flows upwardly on the inner surface 5*a* of the neck 5. Therefore, the resultant high-resistance film 14 takes the desired position along the axis of the neck 5. In addition, the upper-end part of the film 14 can have almost the same thickness as the remaining part of the film 14.

As mentioned above, the jet hole 31*a* of the nozzle 31 for applying the liquid 41 to form a high-resistance film 14 on the inner surface 5*a* of the neck 4 is inclined downwardly. The material liquid 41 applied is therefore inhibited from flowing upwards on the inner surface 5*a*. No part of the liquid 41 would flow upwards and, inevitably, slowly to solidify to form a film that has an uneven thickness.

Having a uniform thickness, the film 14 thus formed exhibits a stable resistance. It therefore can inhibit the charge-up of the neck potential. This reduces the convergence drift caused by a charge-up of the neck potential.

Figure 7A:
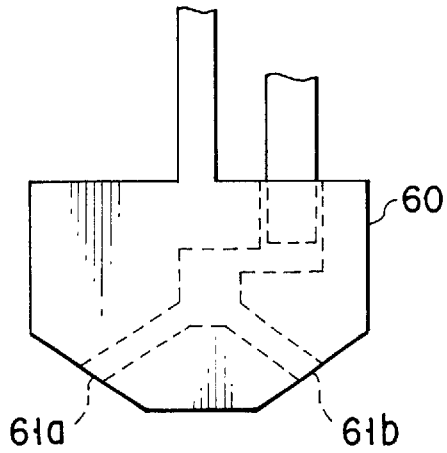
FIG. 7A is a front view of a nozzle having two liquid-applying holes.
Figure 7B:
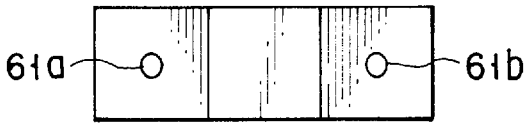
FIG. 7B is the bottom view of the nozzle shown in FIG. 7A.
Figure 8A:
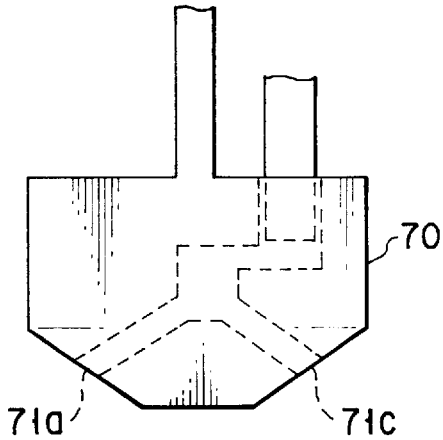
FIG. 8A is a front view of a nozzle having four liquid-applying holes.
Figure 8B:
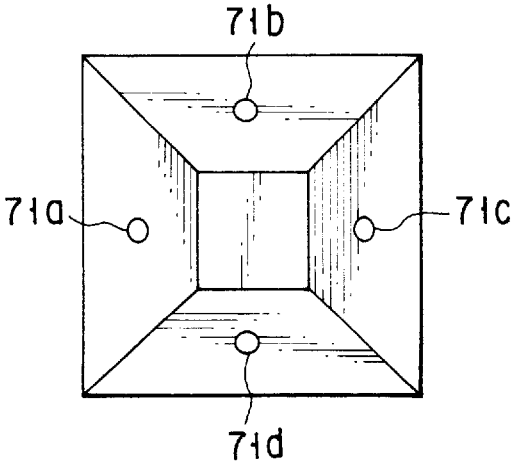
FIG. 8B is the bottom view of the nozzle shown in FIG. 8A.

In the first embodiment described above, the nozzle 31 has one jet hole 31*a*. According to the invention, other types of nozzles may be used, each having a plurality of jet holes that are symmetrical with respect to the axis around which the nozzle is rotated. FIGS. 7A and 7B shows a nozzle 60 that has two jet holes 61*a* and 61*b*. FIGS. 8A and 8B shows a nozzle 70 that has four jet holes 71*a*, 71*b*, 17*c* and 71*d*.

Figure 9:
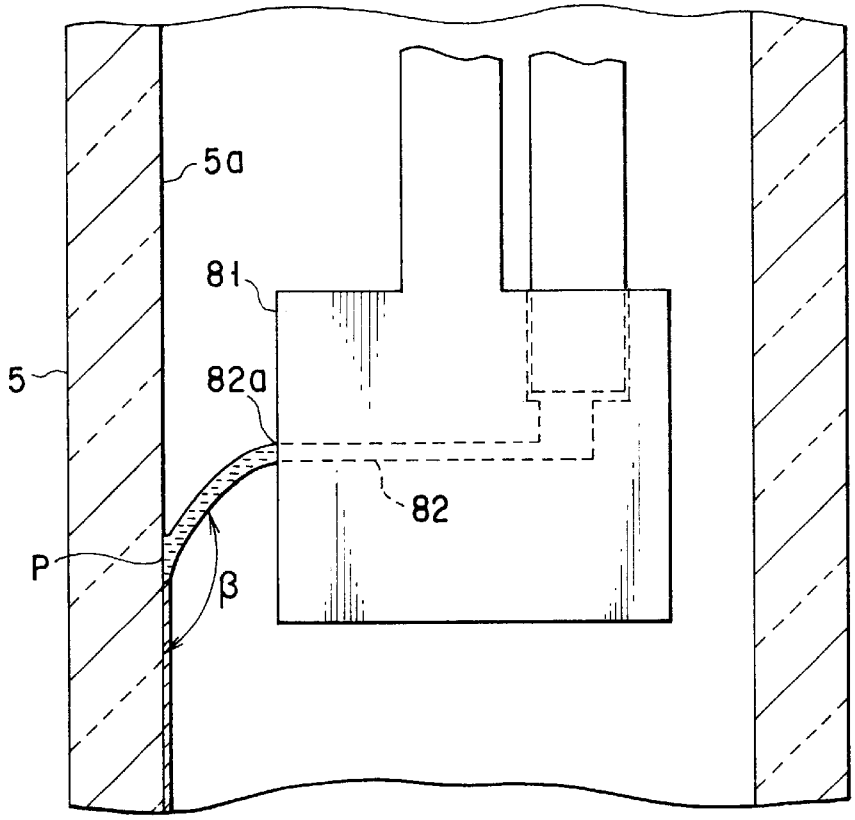
FIG. 9 shows the main section of a coating apparatus according to a second embodiment of this invention.

A coating apparatus according to the second embodiment of this invention will be described, with reference to FIGS. 9 and 10. The components of the second embodiment, which are similar or identical to those of the first embodiment, will not be described in detail in the following description.

In the second embodiment, the nozzle 81 has a jet hole 82 that is not inclined at all. Rather, the feed rate of liquid material 41 (i.e., the amount of liquid applied per unit time) is adjusted so that the liquid 41 may be applied to the inner surface 5*a* of the neck 5 along a line inclined downwardly. More precisely, the feed rate of the liquid material 41 is set at a relatively small value, whereby the liquid 41 is applied to the inner surface 5*a* along a line inclined downwardly as is illustrated in FIG. 9.

The feed rate of the material liquid 41 is adjusted such that the liquid 41 is applied to the inner surface 5*a* along a line inclined to the horizontal plane downwardly, toward the direction of gravity. In other words, the feed rate is adjusted so that the point P on the inner surface 5*a*, where the liquid 41 is applied, is below the level at which the jet hole 82*a* is provided in the nozzle 81. Not only the feed rate is adjusted, but also the rotational speed of the nozzle 81 may be changed in order to apply the liquid 41 to the inner surface 5*a* along a line downwardly inclined to the horizontal plane.

Figure 10:
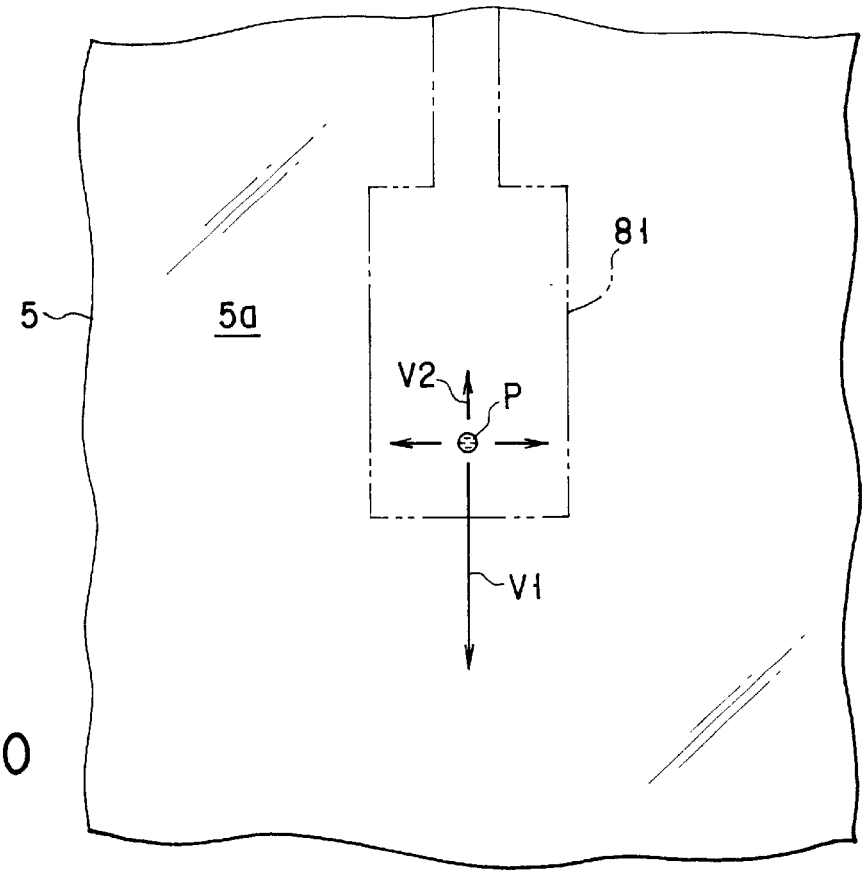
FIG. 10 is a diagram for explaining the behavior of the liquid applied by the nozzle shown in FIG. 9 on the inner surface of the neck of a color cathode ray tube.

As shown in FIG. 10, the speed vector component V2 of that part of the liquid 41 which flows upwards on the inner surface 5*a* is thus small as in the first embodiment. The material liquid 41 so applied as described above can form a high-resistance film 14 having a uniform thickness, on the inner surface 5*a* of the neck 5.

A coating apparatus 90 according to the third embodiment of this invention will be described, with reference to FIGS. 11 and 12. The components of the third embodiment, which are similar or identical to those of the first embodiment, will not be described in detail in the following description.

In the first and second embodiments, the nozzle is rotated in the neck 5 of the funnel 2 held at the predetermined position and applies the material liquid to the inner surface 5*a* of the neck 5. In the third embodiment, the nozzle is not rotated and the funnel 2 is instead rotated, thereby to coat the inner surface 5*a* of the neck 5 with the material liquid.

Figure 11:
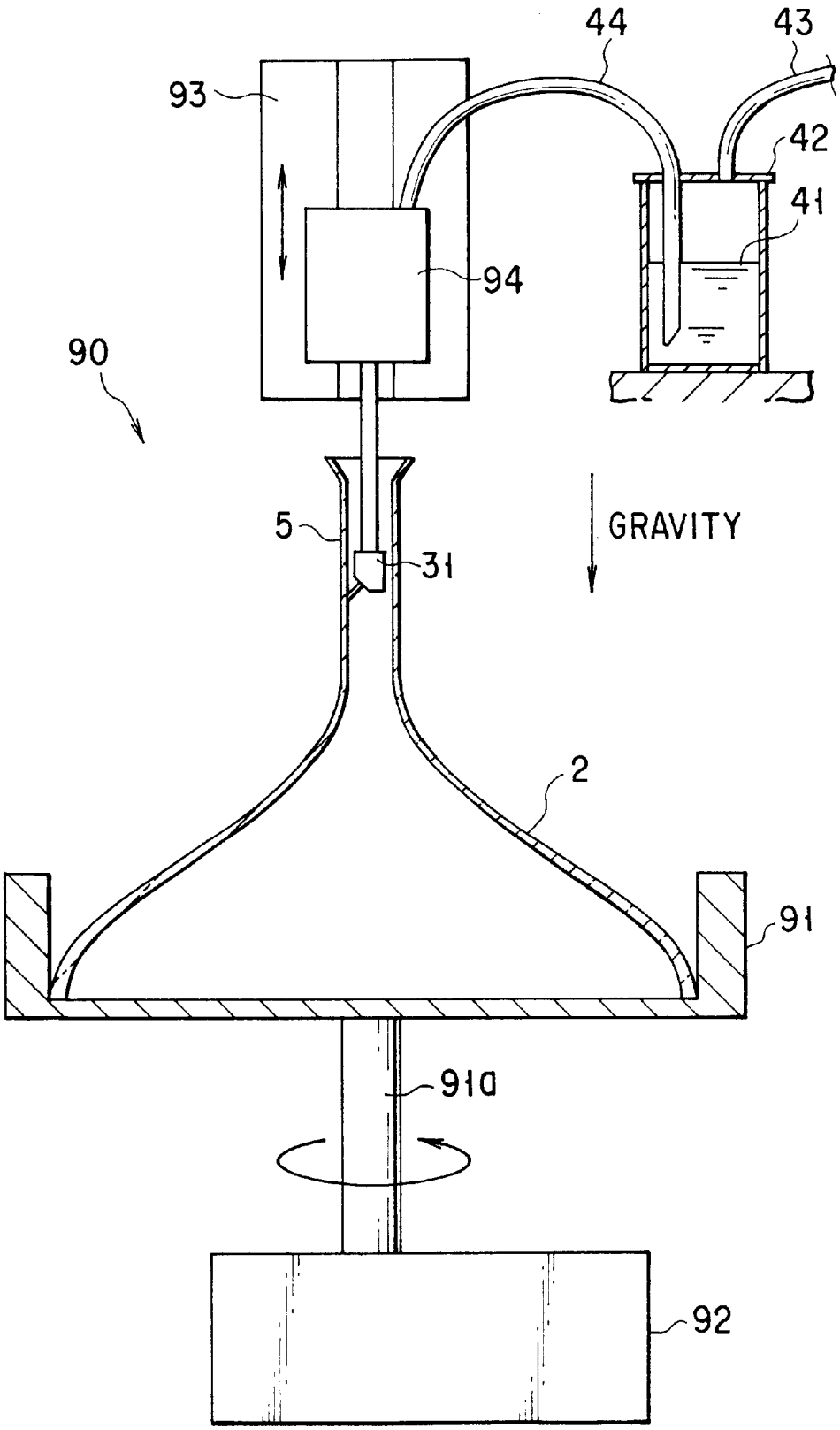
FIG. 11 is a schematic view showing the main section of a coating apparatus according to a third embodiment of the present invention.

FIG. 11 shows the main section of the coating apparatus 90. The coating apparatus 90 comprises a table 91, a table-rotating mechanism 92, and a robot 30. The table 91 has a horizontal amount surface, on which the funnel 2 is mounted with its axis extending in the direction of gravity. The table 91 is connected to a vertical shaft 91*a*, which in turn is connected to the table-rotating mechanism 92. The mechanism 92 is desired to rotate the table 91 at a predetermined speed. The robot 30 has an arm 32.

The coating apparatus 90 further comprises a nozzle 31, a sliding device 93, and a feed-rate-adjusting device 94. The sliding device 93 is attached to the arm 32 of the robot 30. The device 93 supports the nozzle 31 and can move the nozzle 31 up and down in the axial direction of the funnel 2. The nozzle 31 is provided to apply liquid material 41 to the inner surface 5*a* of the neck 5 of the funnel 2. The feed-rate-adjusting device 94 is mounted on the sliding device 93, for adjusting the amount of liquid material 41 applied from the nozzle 31 per unit of time. The liquid 41 is supplied to a pressure tank 42. Since the sliding device 93 is attached to the arm 32 and the feed-rate adjusting device 94 is mounted on the device 93, both devices 93 and 94 can be moved to desired positions by moving the arm 32.

In operation, the nozzle 31 is positioned in the axis of the funnel 2 held on the table 91. Then, the sliding device 93 lowers the nozzle 31 into the neck 5 until the nozzle 31 reaches a prescribed level in the neck 5. The table-rotating mechanism 92 rotates the table 91, thereby rotating,the funnel 2 around its axis. The liquid material 41 is supplied from the pressure tank 42 to the nozzle 31 through a liquid-supplying tube 44 and the feed-rate-adjusting device 94. The liquid 41 is eventually applied to the inner surface 5*a* of the neck 5 through the jet hole 31*a* made in the nozzle 31. The jet hole 31*a* is inclined downwardly to a horizontal plane as in the first embodiment. The liquid 41 applied through the jet hole 31*a* thus inclined can form a high-resistance film 14 having a uniform thickness, on the inner surface 5*a* of the neck 5.

Figure 12:
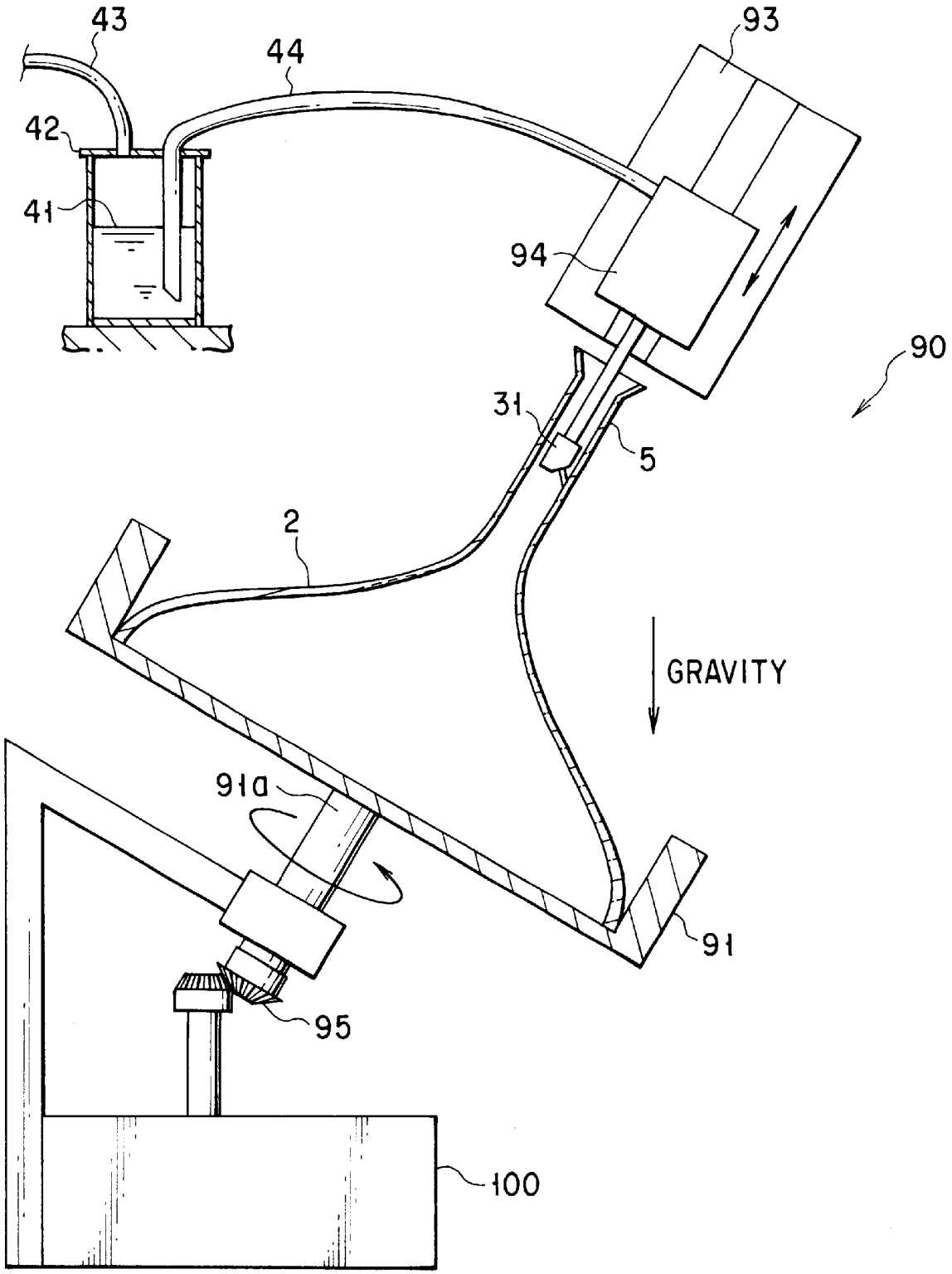
FIG. 12 is a schematic diagram illustrating a modification of the coating apparatus shown in FIG. 11.

FIG. 12 shows a modification of the coating apparatus shown in FIG. 11. The modified coating apparatus is characterized in that the table 91, which can be rotated to rotate the funnel 2, is inclined to the direction of gravity. That is, the shaft 91*a* connected to the table 91 is so inclined. The lower end of the shaft 91*a* is coupled with a table-rotating device 100 by means of a pair of bevel gears 95. The sliding device 93 for moving the nozzle 31 up and down in the neck 5 and the feed-rate adjusting device 94 for adjusting the feed rate of material liquid are attached to the arm 32 and inclined thereto at a predetermined angle. The devices 93 and 94 are therefore set at desired positions.

In operation, the funnel 2 is held on the table 91 thus inclined. The table-rotating device 100 rotates the table 91. The funnel 2 placed on the table 21 is thereby rotated. Since the sliding device 93 holding the nozzle 31 is inclined to the direction of gravity, the jet hole 31*a* of the nozzle 31 extends substantially in the direction of gravity. Therefore, the material liquid applied from the nozzle 31 travels in a substantially vertical direction and is applied along a line inclined to the inner surface 5*a* of the neck 5.

The modified coating apparatus shown in FIG. 12 can thus apply the material liquid along a line inclined to the inner surface 5*a*, in the same way as the apparatus shown in FIG. 11. The modified apparatus can therefore form a high-resist film having a uniform thickness, on the inner surface 5*a* of the neck 5.

The present invention is not limited to the first to third embodiments described above. Various changes and modifications can be made within the spirit and scope of the invention. For example, the first to third embodiments may be combined, thereby to provide another type of a coating apparatus.

The angle at which the jet hole 31*a* of the nozzle 31 is inclined in the first and third embodiments may be of any value. In these embodiments, it suffices to incline the jet hole 31 to the horizontal plane, or downwardly to the direction of gravity, in order to attain the advantage of the present invention. In other words, in the first to third embodiments described above, it suffices to apply the material liquid to the inner surface 5*a* at a point which is below the level at which the outlet end of the jet hole 82*a* is located.

In all embodiments described above, the material liquid 41 is supplied from a pressure tank 42. Nonetheless, the present invention is not limited to the embodiments. It can be applied to a method and apparatus for manufacturing a cathode ray tube, in which the material liquid can be applied through a nozzle.

In all embodiments described above, the liquid material 41 is a solution made of an organic solvent such as ethyl alcohol, tin oxide particles (electrically conductive material) dispersed in the solvent, and silane coupling agent (binder) such as ethyl silicate dispersed in the solvent. The liquid 41 is not limited to this solution. Rather, any other material that can form a high-resistance film on the inner surface 5*a* of the neck 5 may also be used in the present invention. Furthermore, the present invention can be applied to the manufacture of a cathode ray tube that has a funnel comprising a neck having any inner diameter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a cathode ray tube comprising:

an electron gun comprising an electron beam generating section for generating a plurality of electron beams that travel in parallel in a horizontal plane and a plurality of electrodes spaced apart in a direction in which the electron beams travel, each electrode having a plurality of holes for guiding the electron beams;

a deflection yoke for generating magnetic fields in horizontal and vertical directions of a target so as to deflect the electron beams emitted from the electron gun;

an envelope including a neck section in which the electron gun is positioned, a panel section on which the target is provided, and a funnel section which connects the neck section and the panel section and which has an inner diameter flaring from the neck section to the panel section;

an inner conductive film provided on an inner surface of a junction between the funnel section and the neck section; and a high-resistance film formed by coating on an inner surface of the neck section, contacting the inner conductive film, covering a part of the electron gun and having a resistance higher than the inner conductive film, said method consisting of:

arranging the envelope, with the neck section extending in a substantially vertical direction;

supplying a liquid material for forming the high-resistance film into the neck section, said liquid material comprising an alcohol organic solvent, electrically conductive tin oxide particles, and a silane coupling agent dispersed together with the particles in the alcohol organic solvent; and jetting the liquid material through an outlet end toward a point on the inner surface of the neck section, such that all of the liquid material is applied to the inner surface of the neck section along a line inclined to a plane perpendicular to the inner surface, with the outlet end located at a level higher than the point on the inner surface of the neck section onto which the liquid material is applied, thereby forming the high-resistance film in uniform thickness on the inner surface of the neck section.

2. The method according to claim 1, wherein the liquid material is ejected along the line inclined to the plane perpendicular to the inner surface of the neck section, toward the direction of gravity.

3. The method according to claim 2, wherein the liquid material is applied through at least one jet hole inclined to the horizontal plane.

4. The method according to claim 3, wherein a nozzle having said at least one jet hole is rotated in the neck section, thereby to apply the liquid material to the inner surface of the neck section.

5. The method according to claim 1, wherein a feed rate of the liquid material is adjusted, thereby to apply the liquid material to the inner surface of the neck section along a line inclined to the horizontal plane, toward the direction of gravity.

6. The method according to claim 5, wherein the liquid material is applied through at least one jet hole inclined to the horizontal plane.

7. The method according to claim 6, wherein the liquid material is applied by a nozzle having said at least one jet hole, while rotating the nozzle in the neck section.

8. A method of manufacturing a cathode ray tube comprising:

an electron gun comprising an electron beam generating section for generating a plurality of electron beams that travel in parallel in a horizontal plane and a plurality of electrodes spaced apart in a direction in which the electron beams travel, each electrode having a plurality of holes for guiding the electron beams;

a deflection yoke for generating magnetic fields in horizontal and vertical directions of a target so as to deflect the electron beams emitted from the electron gun;

an envelope including a neck section in which the electron gun is positioned, a panel section on which the target is provided, and a funnel section which connects the neck section and the panel section and which has an inner diameter flaring from the neck section to the panel section;

an inner conductive film provided on an inner surface of a junction between the funnel section and the neck section; and a high-resistance film formed by coating on an inner surface of the neck section, contacting the inner conductive film, covering a part of the electron gun and having a resistance higher than the inner conductive film, said method consisting of:

arranging the envelope, with the neck section extending in a substantially vertical direction;

supplying a liquid material for forming the high-resistance film into the neck section, said liquid material comprising an alcohol organic solvent, electrically conductive tin oxide particles, and a silane coupling agent dispersed together with the particles in the alcohol organic solvent;

jetting the liquid material through an outlet end toward a point on the inner surface of the neck section, such that all of the liquid material is applied to the inner surface of the neck section along a line inclined to a plane perpendicular to the inner surface, with the outlet end located at a level higher than the point on the inner surface of the neck section onto which the liquid material is applied, thereby forming the high-resistance film in uniform thickness on the inner surface of the neck section; and rotating the envelope around an axis of the neck section.

9. The method according to claim 8, wherein the liquid material is ejected along the line inclined to the plane perpendicular to the inner surface of the neck section, toward the direction of gravity.

10. The method according to claim 8, wherein a feed rate of the liquid material is adjusted, thereby to apply the liquid material to the inner surface of the neck section along a line inclined to the horizontal plane, toward the direction of gravity.

11. A method of manufacturing a cathode ray tube comprising:

an electron gun comprising an electron beam generating section for generating a plurality of electron beams that travel in parallel in a horizontal plane and a plurality of electrodes spaced apart in a direction in which the electron beams travel, each electrode having a plurality of holes for guiding the electron beams;

a deflection yoke for generating magnetic fields in horizontal and vertical directions of a target so as to deflect the electron beams emitted from the electron gun;

an envelope including a neck section in which the electron gun is positioned, a panel section on which the target is provided, and a funnel section which connects the neck section and the panel section and which has an inner diameter flaring from the neck section to the panel section;

an inner conductive film provided on an inner surface of a junction between the funnel section and the neck section; and a high-resistance film formed by coating on an inner surface of the neck section, contacting the inner conductive film, covering a part of the electron gun and having a resistance higher than the inner conductive film, said method consisting of:

providing the envelope such that the neck section is inclined in a direction relative to a vertical direction;

supplying a liquid material for forming the high-resistance film into the neck section;

ejecting the liquid material toward the inner surface of the neck section such that the liquid material is applied to the inner surface of the neck section along a line inclined to a plane perpendicular to the inner surface of the neck section, toward a direction of gravity, thereby forming the high-resistance film on the inner surface of the neck section; and rotating the envelope around an axis of the neck section.

* * * * *

UNITED STATES PATENT AND TRADEMARK OFFICE

CERTIFICATE OF CORRECTION

PATENT NO. : 6,406,742 B1
DATED : June 18, 2002
INVENTOR(S) : Hasegawa et al.

It is certified that error appears in the above-identified patent and that said Letters Patent is hereby corrected as shown below:

Title page,
Item [75], Inventors, the resident city of the 2nd inventor, Shigeru Sugawara, should be -- Kodama -- instead of "Saitama-ken".

Signed and Sealed this

Eleventh Day of February, 2003

JAMES E. ROGAN
*Director of the United States Patent and Trademark Office*